United States Patent [19]

Dannatt

[11] 4,320,284

[45] Mar. 16, 1982

[54] HEATED FUSER ROLL

[75] Inventor: Hugh S. Dannatt, Bethel, Conn.

[73] Assignee: Pitney Bowes Inc., Stamford, Conn.

[21] Appl. No.: 199,175

[22] Filed: Oct. 22, 1980

[51] Int. Cl.[3] ..... H05B 3/10

[52] U.S. Cl. ..... 219/469; 219/216; 219/505; 355/3 FU; 338/22 R

[58] Field of Search ..... 219/504, 505, 531, 540, 219/216; 338/22 R; 355/3 FU

[56] References Cited

U.S. PATENT DOCUMENTS

| | | | |
|---|---|---|---|
| 3,746,836 | 7/1973 | Summerfield | 219/510 |
| 4,147,927 | 4/1979 | Pirotte | 219/505 |
| 4,213,031 | 7/1980 | Farber | 219/469 |
| 4,242,567 | 12/1980 | Carter | 219/505 |
| 4,253,007 | 2/1981 | Dannatt | 219/216 |

FOREIGN PATENT DOCUMENTS

| | | | |
|---|---|---|---|
| 4519107 | 5/1965 | Japan | 219/505 |
| 54-12960 | 1/1979 | Japan | 219/505 |

*Primary Examiner*—B. A. Reynolds
*Assistant Examiner*—Bernard Roskoski
*Attorney, Agent, or Firm*—Melvin J. Scolnick; William D. Soltow, Jr.; Albert W. Scribner

[57] ABSTRACT

A heated fuser roll for use in a fuser apparatus for fixing toner images to a support surface is disclosed. The fuser roll includes a circular sleeve member having at least one heating unit positioned within the sleeve member. Each heating unit includes (i) a plurality of axially disposed thermally conductive members each formed of a chordal section having a curved surface positioned in contiguous relation to the inside curved surface of the sleeve member and a substantially flat surface, (ii) a plurality of wafer shaped heating elements formed of a semiconducting ceramic material having a positive temperature coefficient of resistivity and exhibiting a Curie temperature transition point at which the resistance of the material increases with increasing temperature, the elements being positioned along the flat surface of each of the conductive members, and (iii) resilient means positioned in contiguous relation to the heating elements for exerting a substantially continuous pressure on the heating elements to keep them in contact with the conductive members. Each of the heating units is separated from each other by an insulating member.

13 Claims, 2 Drawing Figures

HEATED FUSER ROLL

BACKGROUND OF THE DISCLOSURE

I. Field of the Invention

This invention relates to a heated fuser device as is commonly used in xerographic copying machines, and more particularly to a heated fuser roll whose heating elements are formed of a material that enables the fuser to be temperature-self regulating, and positioned and electrically connected within the fuser in a manner which limits electrical current surges.

II. Description of the Prior Art

In a typical xerographic process a photoconductor comprising a photoconductive composition coated on a rigid or flexible substrate is uniformly electrostatically charged in the dark, and then exposed by being illuminated in an image pattern in accordance with graphic material on an original document. The photoconductor becomes discharged in the areas exposed to the illumination, but retains its electrostatic charge in the dark areas, which areas correspond to the graphic material on the original document. The resulting electrostatic latent image is developed by depositing on the photoconductor a finely divided electrostatically attractable developing material (toner), e.g. a heat fusible toner. The toner will normally be attracted to those areas on the photoconductor which retain a charge, thereby forming a toner image corresponding to the electrostatic latent image. This visible image of developing material is then transferred to a support surface, such as plain paper or any other suitable substrate, to become the ultimate copy. Any residual developing material remaining on the photoconductor is cleaned and the photoconductor is reused as described above for subsequent copies. The toner image that was transferred to the plain paper is then fixed thereto. Since the developing material is heat fusible, application of sufficient heat to the paper causes the developing material to melt and be fused into the paper so as to be permanently affixed thereto.

One very basic approach to fusing in a xerographic copying machine is the use of the so-called hot roll pressure fuser apparatus. Typically, in this apparatus, the paper with the toner image thereon is passed between a pair of opposed rollers, at least one of which is heated. Generally, the heated roll is formed of a hollow cylinder having a radiant heater, such as an infrared lamp or a halogen lamp, centrally located within the cylinder to heat the roll, in series with a bimetal thermostat. A typical example of this type of heated fuser roll is illustrated in U.S. Pat. No. 3,637,976. During operation of the fusing apparatus, the paper to which the toner images are electrostatically adhered is passed through the nip formed between the rolls with the toner image contacting the fuser roll to effect heating of the toner image within the nip. Fusing is enhanced by the second roll, or pressure roll as it is commonly called, as the result of a biasing force which forces the rolls into engagement. The thermostat intermittently interrupts the current flow as the roll temperature reaches a predetermined value. The roll then cools to some lower temperature whereupon the thermostat restores the current, and the roll heats up again.

Many of the problems that occur with the use of a hot roll-pressure fusing apparatus are located within the heated fusing roll system. In particular, these problems relate to the means employed for heating the fuser roll and its control. For example, in many of the known hot roll fuser systems it is extremely difficult to maintain a constant temperature at the nip of the rollers where the actual fusing of the toner occurs, and where temperature control is critical. Temperature control is difficult because; (1) it is difficult to sense the temperature in this region; (2) thermal lag, i.e., the responsiveness of roll temperature under varying demands of thermal output; and (3) there are both different machine modes, i.e., standby, off, continuous operation, and different size papers to contend with. The type of thermostat control as described above is conspicuously oscillatory in nature. The thermostat by necessity being situated on the circumference of the roll in order to control the temperature of that surface, is relatively remote from the heater and, thus, the temperature fluctuations are usually significant. Reductions in this aforesaid differential temperature characteristic requires extensive and expensive proportional feedback control means. In addition to these problems, radiant-type heated fuser rolls generally require very high heating temperatures for the heating element to enable the roll temperature in the nip of the rollers to be high enough to melt the toner. The use of these high temperatures can result in deterioration of the fuser roll and thus limit the life of the fuser.

Examples of miscellaneous types of heated rolls that exhibit many of the problems as outlined above are illustrated in U.S. Pat. Nos. 3,471,683, 3,720,808 and 4,100,397.

To overcome many of the types of disadvantages of hot roll fusers as described above, it has been suggested in commonly assigned and copending U.S. Patent application Ser. No. 041,024, filed May 21, 1979, entitled Temperature-Self Regulating Fuser by Donald T. Dolan, to use a fuser member that includes a heating element formed of a material which is capable of heating the fuser member to the required fusing temperature and which is temperature-self regulating. This type of heating element is formed of a semiconducting ceramic material that has a positive temperature coefficient of resistivity and that exhibits a Curie temperature transition point at which the resistance of the material increases with increasing temperature (PTC elements). When operating a fuser containing PTC heating elements, i.e. when the fuser is first turned on, there is an initial surge of current which is undesirable. For example, the initial resistance of a typical hot roll fuser with PTC heating elements is such that for a stack of PTC elements drawing about 1.5 amps the initial switch-on current surge would be in the order of 30 amps. From an economical point of view it would be desirable to reduce this initial surge of current to about one half this amount.

SUMMARY OF THE INVENTION

It is therefore an object of the present invention to overcome many of the disadvantages of the hot roll fusers described in the prior art, and to provide a hot roll fuser (i) that is temperature-self regulating, (ii) will permit relatively simple control of the temperature of the roll in the critical area where fusing occurs, and (iii) will be able to limit the degree of the initial switch-on current surge.

It is a further object of this invention to provide a hot roll fuser which will provide a relatively even temperature gradient along its surfaces, avoid large temperature fluctuations, and eliminate center to edge temperature differentials.

It is a further object of the invention to avoid the use of high temperature heating elements for heating a fuser roll, thereby avoiding deterioration of the fuser roll.

It is still a further object of the invention to provide in addition to all of the objects listed above, a hot roll fuser that employs positive temperature coefficient heating elements in a manner which maintains constant electrical and thermal contact throughout differential expansion cycles.

The foregoing objects and others are accomplished in accordance with the present invention by providing a heated fuser roll for use in a fusing apparatus for fixing toner images to a support surface, the fuser roll comprising a circular sleeve member having at least one heating unit positioned within the sleeve member. Each heating unit includes (i) a plurality of axially disposed thermally conductive members each formed of a chordal section having a curved surface positioned in contiguous relation to the inside curved surface of the sleeve member and a substantially flat surface, (ii) a plurality of wafer shaped heating elements formed of a semiconducting ceramic material having a positive temperature coefficient of resistivity and exhibiting a Curie temperature transition point at which the resistance of the material increases with increasing temperature, the elements being positioned along the flat surface of each of the conductive members, and (iii) resilient means positioned in contiguous relation to the heating elements for exerting a substantially continuous pressure on the heating elements to keep them in contact with the conductive members. Each of the heating units is separated from each other by an insulating member.

The present invention also relates to the application of ceramic heating elements of a class known as positive temperature coefficient materials (PTC) which are disposed within the core of the fuser roll. The preferred ceramic material is described as ferroelectric and has the property of possessing low resistance up to some characteristic temperature. Upon attaining this temperature, the electrical resistance of the ceramic material increases typically from 50 ohms to 5000 ohms or more within a span of less than ten (10) degrees centigrade. It is thus to be appreciated that such a material may be configured to furnish its own thermostat, and furthermore since the effect is internal, pronounced and confined to a narrow temperature band, the oscillatory variations of temperature may be minimized. Such a system has advantages over the conventional and known methods of control. A heated fuser roll having the structure as herein described leads to superior control, the elimination of a conventional thermostat for control of the "switch-on" current surges and a more economical device. The present system also leads to a more reliable device since thermostats are somewhat prone to contact failure. The elimination of a conventional thermostat also eliminates possible electrical interference effects. The self-limiting feature of the heating elements used in the roll eliminates temperature overshoot and promotes rapid heat up.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENT

Figure 1:
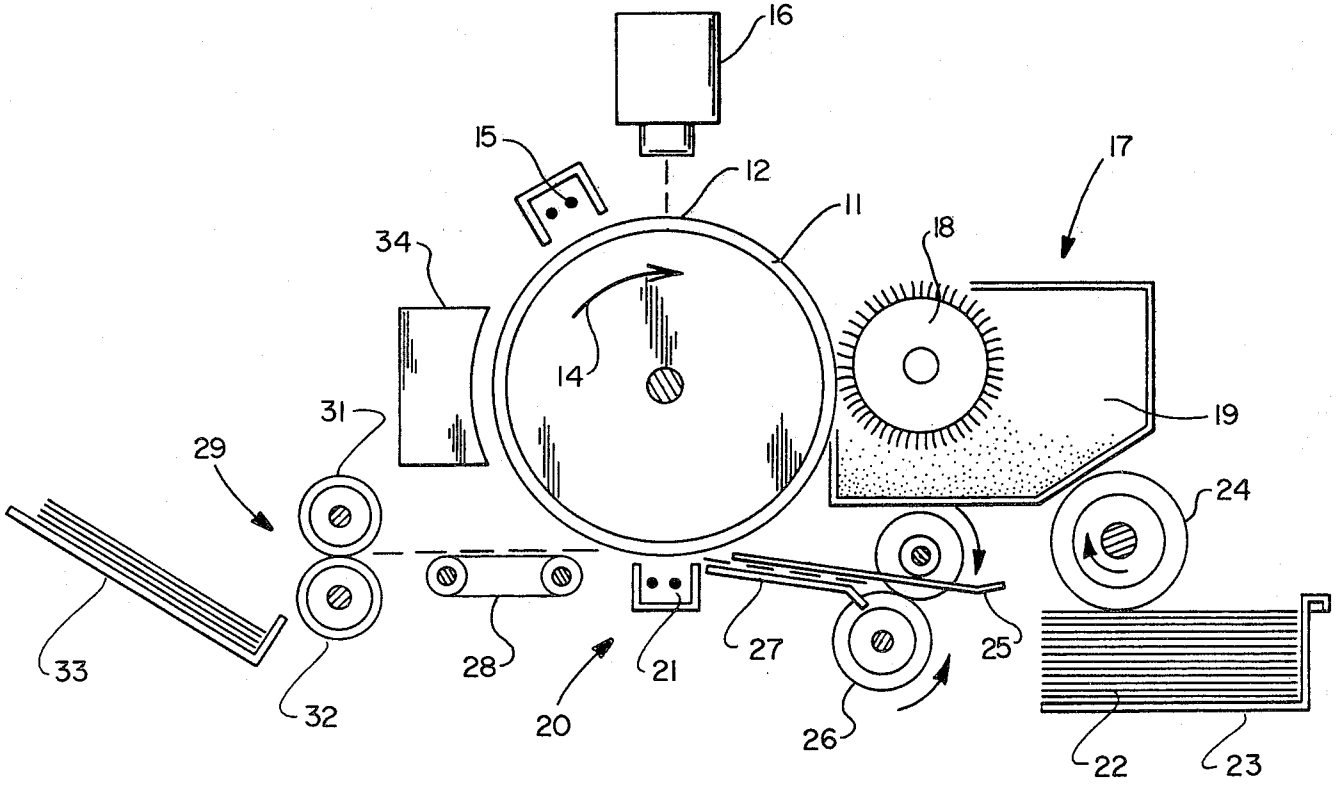
FIG. 1 is a schematic sectional view of a copier.

Referring now to the drawings and particularly to FIG. 1 thereof, there is shown an electrophotographic copying machine employing a fusing device in which a heated fuser roll in accordance with the present invention can be utilized. The various processing stations shown in FIG. 1 will be represented in part as blocks and the processing stations will only be briefly described. The particular copying machine illustrated in FIG. 1 is merely exemplary as far as the present invention is concerned for a complete understanding of an xerographic process and, in particular, how a fusing apparatus is employed in such a process. A fusing apparatus employing a heated fuser roll in accordance with the present invention may be utilized in a wide variety of devices including coated paper copiers and plain paper copiers, and is not necessarily limited to the particular type of copier system shown in FIG. 1.

In FIG. 1, the reference numeral 10 generally designates an electrophotographic copying machine which includes a rotating drum 11 having a photoconductive surface 12 secured around the outer surface of the drum. Any of the numerous inorganic or organic photoconductive materials can be employed, such as, for example, a selenium alloy. Additionally, the photoconductor can be in the form of a belt instead of a drum. As drum 11 rotates in the direction of arrow 14, it passes through the various processing stations disposed around the periphery of the drum.

First, drum 11 rotates a portion of photoconductive surface 12 through a charging apparatus which includes a corona generating device 15 that is positioned closely adjacent the surface of the photoconductor. Corona generating device 15 imparts a uniform electrostatic charge to photoconductor surface 12.

An image of the document to be copied is transmitted to photoconductor surface 12 by the exposure and imaging station generally designated 16. This station could, for example, include a reciprocating carriage that is movably mounted on top of the copying machine cabinet. The carriage would include a transparent platen on which documents are placed faced down for copying. Overlying the platen would be movable cover connected to one side of the carriage. An operator can raise and lower the cover and thereby place on or remove documents from the platen. A series of lamps would be used to illuminate the original document. By incorporating an optical system comprising mirrors and lenses a light image of the original document to be copied is projected onto the charged portion of photoconductive surface 12. The movement of the carriage and therefore the scanning of the original document is in timed relationship with the movement of rotating drum 11. Thus, photoconductive surface 12 is selectively exposed to dissipate the charge thereon and record an electrostatic latent image corresponding to the indicia on the original document.

As drum 11 rotates, the latent image on photoconductive surface 12 is carried past a developer station 17. The developer material used can, for example, be a two component developer which comprises carrier particles having toner particles adhering thereto. The carrier particles are formed of a magnetic material while the toner particles are usually a heat settable plastic. However, a single component toner can also be used. Preferably a magnetic brush developing unit is used in which a rotating magnetic roll 18 picks up toner from a hopper 19 to form a rotating magnetic brush, and carries that toner into contact with the latent image on photoconductive surface 12. The charged or latent image areas of the photoreceptor electrostatically attracts and holds the toner particles, thus developing the latent image.

Transfer station 20 includes a corona transfer charging apparatus 21. In timed relationship with the arrival of the developed image at transfer corona 21, a copy sheet also arrives at transfer station 20. The copy sheet is fed from a supply of sheets 22 stored in removable tray 23. A feed roller 24 feeds the uppermost copy sheet from the supply 22, through paper guide 25 and into the nip of queuing rollers 26. At a predetermined time in the course of a copy cycle, the queuing rollers are actuated to feed the copy sheet along paper guide 27 and into contact with the developed image carried on photoreceptor surface 12. By virtue of the electric charge that is generated by transfer corona 21, toner particles are attracted from photoreceptor surface 12 toward the copy sheet to which they loosely adhere. After transferring the toner powder to the copy sheet, the sheet is stripped away from drum 11 by a suitable stripping apparatus, and advanced by belt conveyor 28 to fixing station 29.

The copy sheet then passes into fixing station 29 which includes a fusing apparatus in which the toner material now residing on the copy paper is heated to a temperature at which the toner particles melt and are thereby fused into the copy paper so as to form a permanent copy of the original document. As shown, the fuser apparatus includes a heated fuser member or roll 31, and a backup member or roll 32. The copy sheet with the toner powder image thereon is interposed between fuser roll 31 and backup roll 32. A release material, e.g. polytetrafluoroethylene, can be on the fuser roll to prevent offset and allow for easy release of the paper from the roll. After the toner image is permanently affixed to the copy sheet, the sheet is separated from the fuser roll and advanced to a catch tray 33 for subsequent removal from the copier by an operator.

In order to remove residual toner particles which adhere to photoconductive surface 12 after the transfer of the powder image to the copy sheet, copying machine 10 is provided with a cleaning system generally designated by reference number 34. The cleaning mechanism can, for example, include a corona generating device and a brush which contacts photoconductive surface 12. First, the remaining toner particles are brought under the influence of the corona generating device to neutralize the electrostatic charge remaining on photoconductive surface 12 and that of the residual toner particles. Thereafter, the neutralized particles are removed from surface 12 by the rotatably mounted brush. After the cleaning operation, a discharge lamp can be used to discharge remaining charges on surface 12 prior to the recharging thereof at corona device 15 for the next copying cycle.

Figure 2:
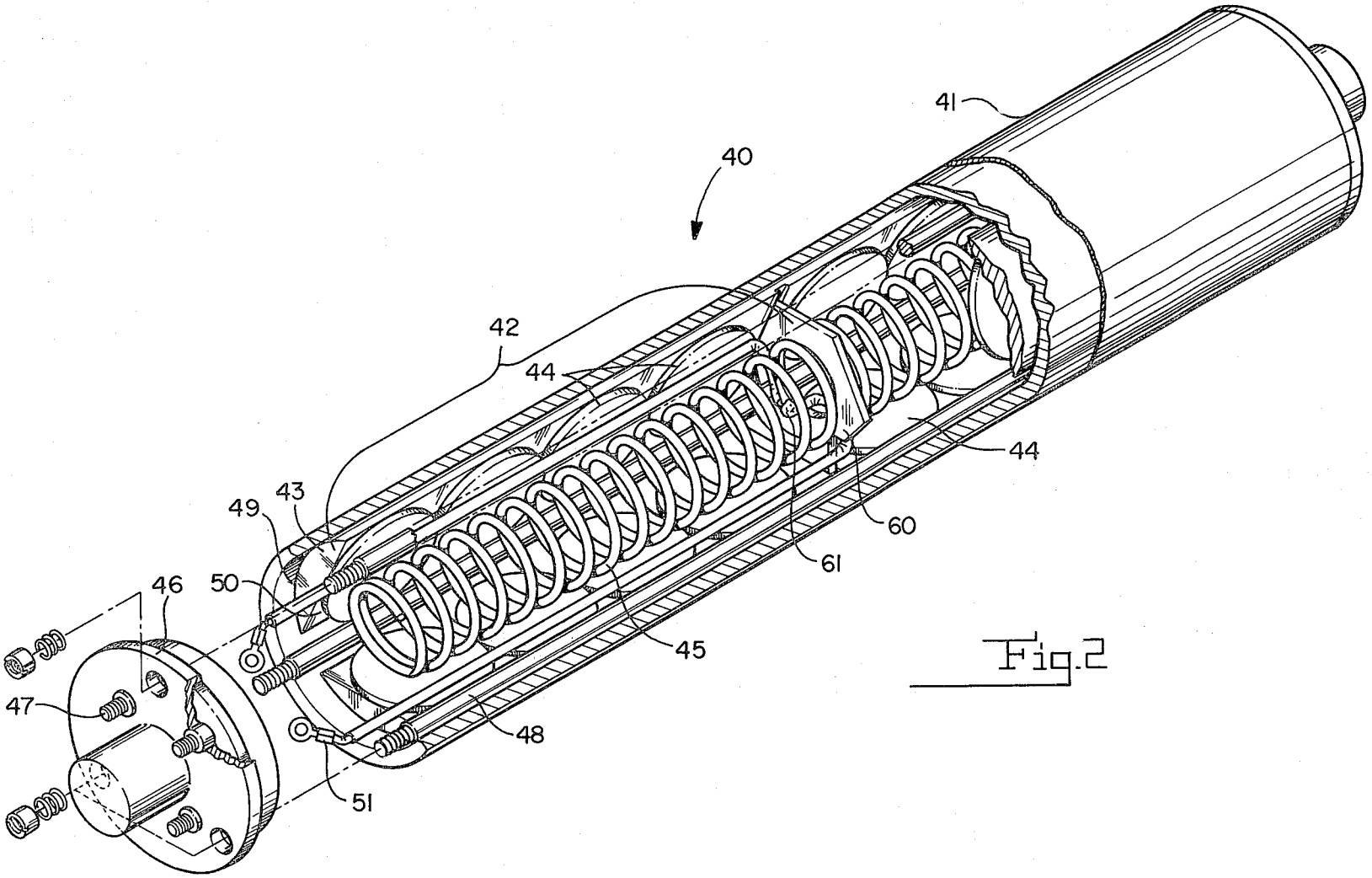
FIG. 2 is an exploded perspective view partly in section of an embodiment of a heated fuser roll in accordance with the present invention.

Referring now to the specific subject matter of the present invention, there is illustrated in FIG. 2 a heated fuser roll 40 in accordance with the features of the present invention. Fuser roll 40 is in the form of a circular metal cylinder illustrated as circular sleeve member 41. Positioned within the sleeve member is at least one heating unit 42. Each heating unit 42 in accordance with the present invention, includes a plurality of axially disposed thermally conductive members 43, a plurality of wafer shaped heating elements 44 and resilient means, illustrated in FIG. 2, in the preferred form of a spring member 45. In accordance with the present invention a heated fuser roll 40 can include only one heating unit 42. However, it is preferred to employ a plurality of these heating units in a fuser roll to obtain the maximum heating benefits therefrom. Mounted to the end portions of sleeve member 41 are electrically non-conductive end plugs 46 with concentric stub shafts 47. End plugs 46 are secured to sleeve member 41 by rods 48 which are preferably covered with an insulating material.

Provided within sleeve 41 are a plurality of thermally conductive members 43 which provide the means for allowing the heat to flow from heating elements 44 to the working surface of fuser roll 40. Members 43 are therefore preferably made of a material having excellent thermal conductivity properties. Materials which are eminently suited for this purpose include, for example, metals such as aluminum, copper or brass. Members 43 are each formed of a chordal section having a curved surface 49 and a substantially flat surface 50, and as shown in FIG. 2, are preferably set apart within sleeve 41 at about 120 degrees one to another with each curved surface 49 positioned in contiguous relation to the inside curved surface of the sleeve member. To maximize the possible heating effect, members 43 are preferably constructed of as long a length of conductive material as possible which would premit end plugs 46 to fit upon the ends of sleeve 41. It is also within the scope of the present invention that conductive members 43 be part of sleeve member 41 in that both of these members are formed of a unitary extruded piece.

Heating elements 44 are formed of a semiconducting ceramic material which has a positive temperature coefficient of resistivity and exhibits a Curie temperature transition point at which the resistance of the material increases with increasing temperature. The preferred semiconducting ceramic materials embodied within the present invention have a Curie temperature or transition temperature such that when the material reaches its particular Curie temperature the resistance of these materials increases by several powers of ten. These materials, when employed as heating elements 44 impart to fuser roll 40 the ability to operate as a self-regulating heat source. At a given voltage the heating elements will draw a high current. This is because the elements are cold and their resistance is low. Within a few seconds the Curie temperature of the ceramic material is reached, there is a sharp increase in resistance, e.g. from 50 ohms to 5,000 ohms, and an immediate restriction in the amount of power absorbed. Thereafter, a state of equillbrium arises in which the power absorbed adjusts itself such that it is equal to the heat dissipated. Thus, the material tends to keep its temperature substantially in the vicinity of the Curie temperature. The particular ceramic material composition that is chosen for use as the heating element, of course, depends upon the fusing temperature requirements. In accordance with the present invention, ceramic semiconducting materials that exhibit Curie temperatures within the range of about 150 degrees C. to about 220 degrees C. are the preferred materials for use as heating elements 44 in view of the temperatures required to fuse most commercially available toners. Compositions comprising barium titanate with strontium titanate and/or lead titanate, and a small amount of lanthanum in the form of lanthanum titanate, e.g., 0.3 mol%, (lanthanum is added in sufficient amount to impart semiconductive properties to the material) are particularly well suited as compositions for these heating elements. Details of these ceramic materials as heating elements for fusers can be found in commonly assigned and copending U.S. Patent Application Ser. No. 041,024, filed May 21, 1979, entitled "Temperature-Self Regulating Fuser" by Donald T. Dolan. The heating elements are preferably in the form of circular wafers 44. An example of the physical dimensions for one preferred wafer-type heating element in accordance with the present invention would be a wafer having a diameter of about one inch and a thickness of about 0.125 inches. As shown in FIG. 2 heating elements 44 are positioned along the flat surfaces 50 of each of thermally conductive members 43 so as to maximize the amount of heat that can flow to the working surface of fuser roll 40 through the conductive members.

It is preferred to coat both of the flat surfaces of heating elements 44 with a metal coating of a sufficient thickness to (i) achieve proper electrical contact between the heating elements and spring member 45, and (ii) achieve uniform contact between the heating elements and the flat surfaces 50 of each of thermally conductive members 43 to allow for efficient heat transfer. A coating thickness ranging from about 0.001" to about 0.002" of a material such as silver or aluminum is preferred. These coatings can be placed on the heating elements by, for example, a vacuum deposition process or a suitable silk screening process.

Located axially within sleeve 41 is a resilient means preferably in the form of spring member 45 that is positioned within the sleeve so as to be in contiguous relation to heating elements 44 for the purpose of exerting a substantially continuous pressure on the heating elements to keep them in contact with the flat surfaces 50 of thermally conductive members 43 and thereby provide for an efficient method for bringing the heat from the heating elements to the working surface of the fuser. In addition, spring member 45 is the means by which the electric current flows from the electric source through wire conductors 51 to the spring and subsequently to each of the heating elements. To adequately serve both of these functions, the spring member is made from a material (a) that has a self-adjusting resiliency throughout various temperature fluctuations whereby the spring member will continue to exert a substantially steady pressure on heating elements 44 so as to keep them in continuous contact with thermally conductive members 43 throughout the repeated thermal cycles, i.e., heating and cooling, which occur during operation of the fuser, and (b) that is electrically conductive. An example of the type of spring material that achieves these desired results is a spring made of steel that has been electroplated, such as with copper or silver. A spring material having a copper plating is commercially available as Copperply, a wire material manufactured by the National-Standard Company. Spring member 45 can be easily and properly inserted within sleeve 41 by using the type of assembly tool and procedure as described in my copending and commonly assigned U.S. patent application Ser. No. 199,174 filed Oct. 22, 1980, entitled "Assembly Tool".

Separating each of heating units 42 within fuser 40 is an insulating plate 60 which can be formed of any of the numerous types of insulating materials, such as, for example, glass epoxy. As shown in FIG. 2, each of spring members 45 abuts the insulating plate 60 along with wire lead 61 which in turn is connected to the electrical source for the fuser.

Sleeve member 41 preferably formed of a material having high thermal conductivity characteristics, such as for example, aluminum, brass or copper contains all of the internal parts of the fuser, and provides the basic work surface for heated fuser roll 40. Sleeve member 41 is also preferably provided with an outer layer of a material which will help prevent offsetting or sticking of the toner to the roll as the roll rotates in contact with the toner. For example, the outer layer can be fabricated of a polytetrafluoroethylene material (e.g., Teflon) or a silicone elastomer coated with silicone oil, as well as silicone elastomers containing low surface energy fillers such as fluorinated organic polymers, and the like.

While this invention has been described in conjunction with a specific embodiment thereof, it is evident that many alternatives, modifications and variations will be apparent to those skilled in the art. Accordingly, the present invention is intended to embrace all such alternatives, modifications and variations and fall within the spirit and scope of the appended claims.

I claim:

1. A heated fuser roll for use in a fuser apparatus for fixing toner images to a support surface, said fuser roll comprising:

a. a circular sleeve member;

b. a plurality of heating units positioned within said sleeve member, each unit including (i) a plurality of axially disposed thermally conductive members each formed of a chordal section having a curved surface positioned in contiguous relation to the inside curved surface of said sleeve member and a substantially flat surface, the chordal sections being set apart within said sleeve at about 120° one to another, (ii) a plurality of wafer shaped heating elements formed of a semiconducting ceramic material having a positive temperature coefficient of resistivity and exhibiting a Curie temperature transition point at which the resistance of said material increases with increasing temperature, said elements being positioned in contiguous relation to one another along said flat surface of each of said conductive members, and (iii) resilient means in the form of an open coil spring extending axially within said sleeve member positioned in contiguous relation to said heating elements for exerting a substantially continuous pressure on said heating elements to keep said elements in contact with said conductive members and to provide a plurality of independent multiple electrical contacts with said elements; and c. each heating unit being separated from the adjacent heating unit by an insulating member, said spring of each unit extending to abut the insulating member.

2. A fuser roll according to claim 1 wherein said resilient means has a self-adjusting resiliency whereby said resilient means remains in contiguous contact with said heating elements during the heating and cooling cycles of said fuser.

3. A fuser roll according to claim 1 wherein said spring is formed of an electrically conductive material.

4. A fuser roll according to claim 3 wherein said spring is formed of steel wire coated with a layer of copper or silver.

5. A fuser roll according to claim 1 wherein each of said heating elements have two opposed substantially flat and parallel surfaces, each of said surfaces being plated with metal.

6. A fuser roll according to claim 5 wherein said metal plating is silver or aluminum.

7. A fuser roll according to claim 1 further comprising means for supplying an electrical current to each of said heating units.

8. A fuser roll according to claim 1 wherein said ceramic material exhibits a Curie temperature ranging from about 150° C. to about 220° C.

9. A fuser roll according to claim 8 wherein said ceramic material comprises barium titanate, strontium titanate, and/or lead titanate and lanthanum.

10. A fuser roll according to claim 1 wherein said sleeve is made of aluminum, copper or brass.

11. A fuser roll according to claim 1 further comprising an outer layer of silicone rubber covering said sleeve.

12. A fuser roll according to claim 1 further comprising an outer layer of polytetra-fluoroethylene covering said sleeve.

13. A heated fuser roll for use in a fuser apparatus for fixing toner images to a support surface, said fuser roll comprising:

a. a circular sleeve member;

b. a plurality of heating units positioned within said sleeve member, each unit including (i) a plurality of axially disposed thermally conductive members each formed of a chordal section extending from the inside surface of said sleeve, said chordal sections each having a flat surface, the chordal sections being set apart within said sleeve at about 120° one to another, (ii) a plurality of wafer shaped heating elements formed of a semiconducting ceramic material having a positive temperature coefficient of resistivity and exhibiting a Curie temperature transition point at which the resistance of said material increases with increasing temperature, said elements being positioned in contiguous relation to one another along said flat surface of each of said conductive members, and (iii) resilient means in the form of an open coil spring extending axially within said sleeve member positioned in contiguous relation to said heating elements for exerting a substantially continuous pressure on said heating elements to keep said elements in contact with said conductive members and to provide a plurality of independent multiple electrical contacts with said elements; and c. each heating unit being separated from the adjacent heating unit by an insulating member, said spring of each unit extending to abut the insulating member.

* * * * *